US008180238B2

(12) United States Patent
Inukai

(10) Patent No.: US 8,180,238 B2
(45) Date of Patent: May 15, 2012

(54) VOLTAGE CONTROL IN AN IMAGE FORMING APPARATUS

(75) Inventor: Katsumi Inukai, Iwakura (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 461 days.

(21) Appl. No.: 12/365,909

(22) Filed: Feb. 5, 2009

(65) Prior Publication Data

US 2009/0202265 A1 Aug. 13, 2009

(30) Foreign Application Priority Data

Feb. 8, 2008 (JP) ..... 2008-029387

(51) Int. Cl.
*G03G 15/16* (2006.01)
*G03G 15/18* (2006.01)

(52) U.S. Cl. ..... 399/66; 399/154

(58) Field of Classification Search ..... 399/66, 399/154

See application file for complete search history.

(56) References Cited

FOREIGN PATENT DOCUMENTS

JP 2003-295633 10/2003
JP 2003280409 A * 10/2003
JP 2006-276471 10/2006
JP 2007-034092 2/2007
JP 2008203363 A * 9/2008

OTHER PUBLICATIONS

Notice of Reasons for Refusal for Japanese Patent Application No. 2008-029387 dated Feb. 16, 2010.

* cited by examiner

*Primary Examiner* — David Porta
*Assistant Examiner* — Carolyn Igyarto
(74) *Attorney, Agent, or Firm* — Banner & Witcoff, Ltd.

(57) ABSTRACT

An image forming apparatus includes an image carrier for carrying developer image, a transfer device configured to transfer the developer image to a recording media, a forward bias applying circuit configured to apply a forward bias voltage to the transfer device, and a reverse bias applying circuit configured to apply a reverse bias voltage to the transfer device. The apparatus includes a detecting circuit configured to detect inflow current flowing from the image carrier into the forward bias applying circuit, and a decision circuit configured to determine a lower limit of the reverse bias voltage based on a detected value of the inflow current when the detected value of the inflow current exceeds a first predetermined value. The reverse bias applying circuit applies the reverse bias voltage of the determined lower limit to the transfer device at least before the forward bias voltage is applied to the transfer device.

2 Claims, 9 Drawing Sheets

VOLTAGE CONTROL IN AN IMAGE FORMING APPARATUS

CROSS REFERENCE TO RELATED APPLICATION

This application claims priority from Japanese Patent Application No. 2008-029387 filed on Feb. 8, 2008. The entire content of this priority application is incorporated herein by reference.

TECHNICAL FIELD

The present invention relates to an image forming apparatus. More specifically, the present invention relates to bias voltage applied to a transfer roller of the image forming apparatus.

BACKGROUND

It is known that a reverse bias voltage is applied to a transfer roller prior to applying a forward bias voltage. This prevents leak current from a photosensitive drum flowing to a forward bias applying device that generates the forward bias voltage, and can avoid a condition where start-up of the forward bias applying device is disabled under influence of the leak current.

However, in this art, an output of the reverse bias voltage is decreased after being applied. Therefore, in a case where the reverse bias voltage is set lower, start-up of the forward bias applying device could be disabled and cause transfer error and inferior print quality. On the other hand, in a case of applying a highly set reverse bias voltage while applying the forward bias voltage, it is necessary to continue applying a higher forward bias voltage, and thus, this configuration cannot be efficient.

SUMMARY

One aspect of the present invention to achieve the purpose is an image forming apparatus including an image carrier configured to carry developer image developed with developer, a transfer device configured to transfer the developer image to a recording media, and a forward bias applying circuit configured to apply a forward bias voltage to the transfer device. The forward bias voltage has a polarity opposite to the developer. The image forming apparatus also includes a reverse bias applying circuit configured to apply a reverse bias voltage to the transfer device. The reverse bias voltage has a polarity opposite to the forward bias voltage.

The image forming apparatus also includes a detecting circuit configured to detect inflow current flowing from the image carrier through the transfer device into the forward bias applying circuit, and a decision circuit configured to determine a lower limit of the reverse bias voltage based on a detected value of the inflow current when the detected value of the inflow current exceeds a first predetermined value. The reverse bias applying circuit applies the reverse bias voltage of the determined lower limit to the transfer device at least before the forward bias voltage is applied to the transfer device.

With this aspect, when the detected value of the inflow current exceeds the first predetermined value, the lower limit of the reverse bias voltage is determined based on the detected value of the inflow current, and the determined lower limit of the reverse bias voltage is applied to the transfer device at least before the forward bias voltage is applied to the transfer device. Therefore, by setting the first predetermined value at a value where the inflow current has no influence on start-up of the forward bias applying device, the influence of the inflow current can be suitably eliminated by applying the reverse bias voltage of the lower limit to the transfer device when transferring the developer image to the recording media. In this case, because the value of the reverse bias voltage can be optimized to a lower voltage, efficient control for stably operating the forward bias applying circuit can be realized.

DETAILED DESCRIPTION

<First Illustrative Aspect>

A first illustrative aspect in accordance with the present invention will be described with reference to FIGS. 1 through 5.

1. Main Configuration of Image Forming Apparatus

Figure 1:
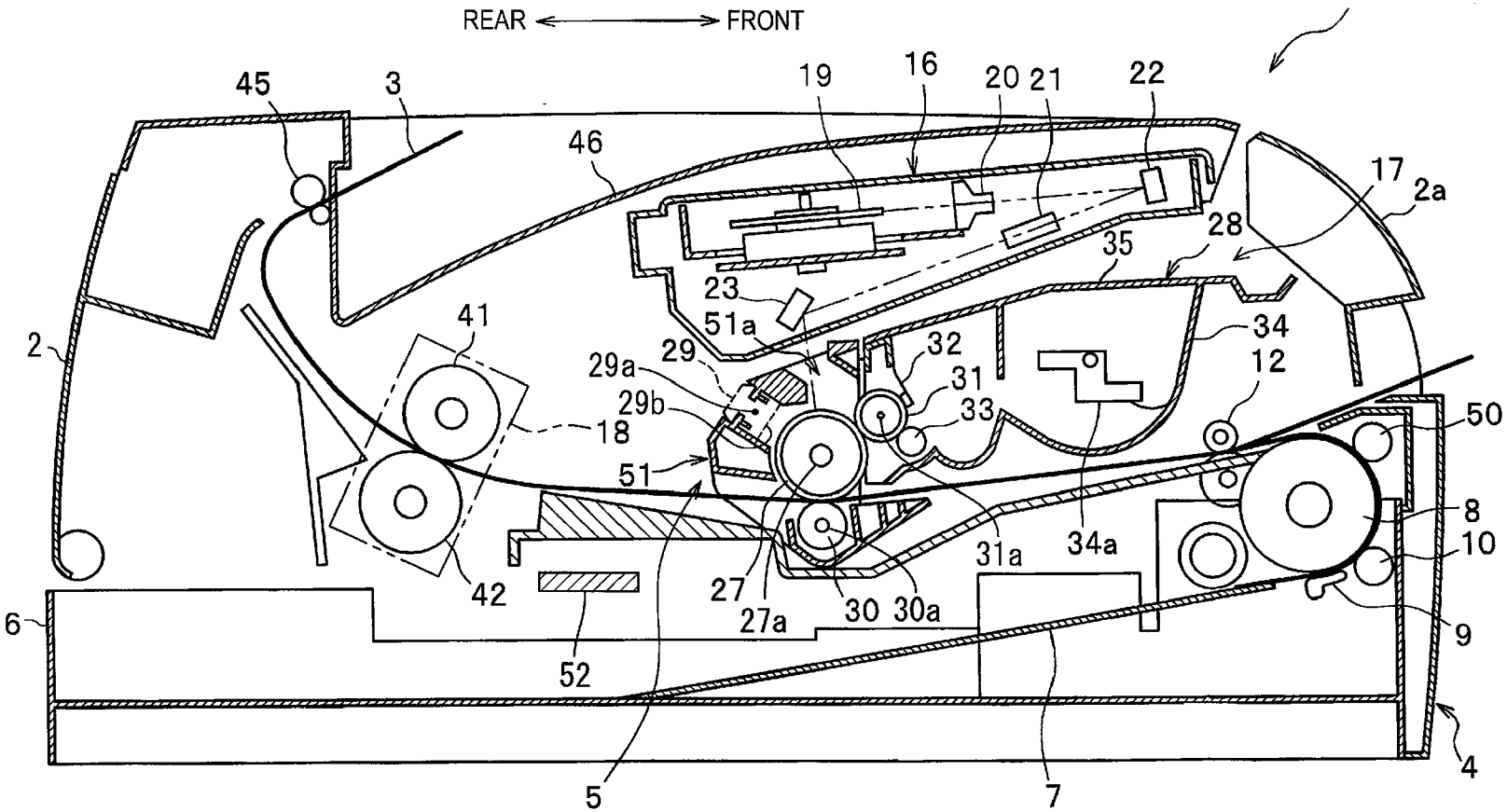
FIG. 1 is a side sectional view showing an internal configuration of a laser printer in accordance with the present invention.

FIG. 1 is a schematic main-part side sectional view showing one illustrative aspect of a laser printer 1, which is one example of an image forming apparatus in accordance with the present invention. As shown in FIG. 1, the laser printer 1 includes a body frame 2, a sheet-feeding unit 4, an image forming mechanism 5, and the like. The body frame 2 is an apparatus body of the image forming apparatus. The sheet-feeding unit 4 is disposed in the body frame 2. The sheet-feeding unit 4 feeds sheets 3 (an illustration of recording media; herein sheet is broadly defined as paper, plastic, and the like). The image forming mechanism 5 forms images on the fed sheets 3. Note that the image forming apparatus is not limited to a printer (the laser printer); the image forming apparatus includes also a facsimile apparatus or a complex machine having a printer function and a scanner function and the like.

(1) Sheet-Feeding Unit

The sheet-feeding unit 4 is disposed in the bottom portion of the body frame 2. The sheet-feeding unit 4 includes a sheet-feed tray 6, a sheet-pressing plate 7, a sheet-feed roller 8, a sheet-feed pad 9, a pinch roller 10, a sheet-dust removing roller 50, and a registration roller 12. The sheet-feed tray 6 is detachably attached in the body frame 2. The sheet-pressing plate 7 is disposed in the sheet-feed tray 6. The sheet-feed roller 8 is disposed above an end portion (the right side in FIG. 1) of the sheet-feed tray 6 (hereinafter, this side will be referred to as a front side, while the opposite side thereof (the left side in FIG. 1) will be referred to as a rear side). The sheet-dust removing roller 50 is disposed downstream of the sheet-feed roller 8 in the conveying direction of the sheets 3. The registration roller 12 is disposed downstream of the sheet-dust removing roller 50 in the conveying direction of the sheets 3.

The sheet 3 which is located at an uppermost position on the sheet-pressing plate 7 is pressed by a spring (not illustrated) toward the sheet-feed roller 8 from the backside of the sheet-pressing plate 7. Upon rotation of the sheet-feed roller 8, the sheet 3 is held between the sheet-feed roller 8 and the sheet-feed pad 9, and is fed. The sheets 3 are fed one by one in this manner.

Sheet dust on the fed sheet 3 is removed by the sheet-dust removing roller 50. The sheet 3 is then sent to the registration roller 12. The registration roller 12 includes two rollers. The registration roller 12 registers the sheet 3 and then sends the sheet 3 to an image forming position. Note that the image forming position is a transfer position where a toner image on the photosensitive drum 27 is transferred to the sheet 3. In this illustrative aspect of the present invention, the image forming position is a contact position of the photosensitive drum 27 with the transfer roller 30.

(2) Image Forming Mechanism

The image forming mechanism 5 includes a scanner 16, a process cartridge 17, and a fixing unit 18.

(a) Scanner

The scanner 16 is disposed in the top portion of the body frame 2. The scanner 16 includes a laser emitter (not illustrated), a polygon mirror 19, lenses 20, 21, and reflecting mirrors 22, 23. The Polygon mirror is rotatably driven. Laser beam is emitted based on an image data from the laser emitter and, as shown by dashed line in FIG. 1, passes through, or is reflected by, the polygon mirror 19, the lens 20, the reflecting mirror 22, the lens 21, and the reflecting mirror 23, in that order, and irradiated to a surface of the photosensitive drum 27 of the process cartridge 17 by high-speed scanning.

(b) Process Cartridge

The Process cartridge 17 is disposed below the scanner 16. The process cartridge 17 includes a drum unit 51 and a developer cartridge 28. The drum unit 51 is detachably attached to the body frame 2. The developer cartridge 28 is received in the drum unit 51. Note that the front face of the body frame 2 is provided with a front cover 2*a*, as shown in FIG. 1. The front cover 2*a* can be opened and closed in a pivoting manner about the bottom edge portion thereof. The front cover 2*a*, when opened, allows the process cartridge 17 to be detachably accommodated in the body frame 2.

The developer cartridge 28 is detachably attached to the drum unit 51. The developer cartridge 28 includes, for example, a developing roller 31, a layer-thickness regulating blade 32, a toner supply roller 33, a toner hopper 34, and the like.

The toner hopper 34 is filled with toner (an illustration of developer) having a positive charge property. The toner hopper 34 is provided with an agitator 34*a* in the center thereof. The toner in the toner hopper 34 is agitated by the agitator 34*a*.

The toner supply roller 33 is rotatably disposed behind the toner hopper 34. Furthermore, the developing roller 31 is rotatably disposed in a manner opposed to the toner supply roller 33. The toner supply roller 33 and the developing roller 31 have contact with each other in a manner each compressed by the other to some extent.

The toner supply roller 33 has a metal roller shaft, which is covered with a roller made of conductive foam material. Furthermore, the developing roller 31 has a metal roller shaft 31*a*, which is covered with a roller made of conductive rubber material. Note that the developing roller 31 is applied with a predetermined developing bias voltage at a time of developing process.

In addition, the layer-thickness regulating blade 32 is disposed near the developing roller 31. The layer-thickness regulating blade 32 is supported near the developing roller 31 by the developer cartridge 28 and is pressed onto the developing roller 31 by the elastic force of the blade body.

The toner sent from the toner hopper 34 is supplied onto the developing roller 31 by rotation of the toner supply roller 33. The toner is then frictionally charged in the positive polarity between the toner supply roller 33 and the developing roller 31. Furthermore, along with rotation of the developing roller 31, the toner supplied onto the developing roller 31 enters between the layer-thickness regulating blade 32 and the developing roller 31, and is carried on the developing roller 31 to form a thin layer having an even thickness.

The drum unit 51 includes a photosensitive drum 27 (an illustration of an image carrier), a scorotron charger 29, and a transfer roller 30 (an illustration of a transfer device), and the like.

The photosensitive drum 27 is disposed in a manner opposed to the developing roller 31. The photosensitive drum 27 is rotatably supported in the drum unit 51. The photosensitive drum 27 includes a tubular drum body and a metal drum shaft 27*a*. The drum shaft 27*a* is disposed in the axis of the drum body, and supports the drum body. The drum body is provided with a photosensitive layer on the surface thereof. The photosensitive layer has a positive charge property. In addition, an exposing aperture 51*a* is defined in a casing of the drum unit 51. The exposing aperture 51*a*, which has a hole shape, is defined above the photosensitive drum 27. In addition, the drum shaft 27*a* is grounded (see FIG. 2).

The scorotron charger 29 is disposed above the photosensitive drum 27 in a manner opposed to the photosensitive drum 27 at a predetermined distance therefrom so as not to have contact therewith. The scorotron charger 29 is a positive-charging scorotron charger that generates corona discharge from a charging wire 29*a*, which is formed of tungsten or the like. The scorotron charger 29 includes the charging wire 29*a* and a grid 29*b*. The grid 29*b* is located between the charging wire 29*a* and the photosensitive drum 27. The scorotron charger 29 uniformly and positively charges the surface of the photosensitive drum 27 (for example, to about 870 V) along with applying a predetermined charging bias voltage (of, for example, 5 kV to 8 kV) to the charging wire 29*a*.

Then, with rotation of the photosensitive drum 27, the surface of the photosensitive drum 27 is first uniformly and positively charged by the scorotron charger 29 and, thereafter, is exposed to the high-scanning of the laser beam emitted from the scanner 16. Electrostatic latent image based on image data is thus formed.

Next, as the developing roller 31 rotates, the toner which is carried on the surface of the developing roller 31 and is positively charged faces the photosensitive drum 27, and contacts therewith. The toner is then supplied to the electrostatic latent image formed on the surface of the photosensitive drum 27, and is selectively carried thereon. The electrostatic latent image is thus developed, and the developing process is completed.

The transfer roller 30 is disposed under the photosensitive drum 27 in a manner opposed to the photosensitive drum 27. The transfer roller 30 is rotatably supported by the casing of the drum unit 51. The transfer roller 30 has a metal roller shaft 30*a*, which is covered with a roller made of, for example, conductive rubber material.

Figure 2:
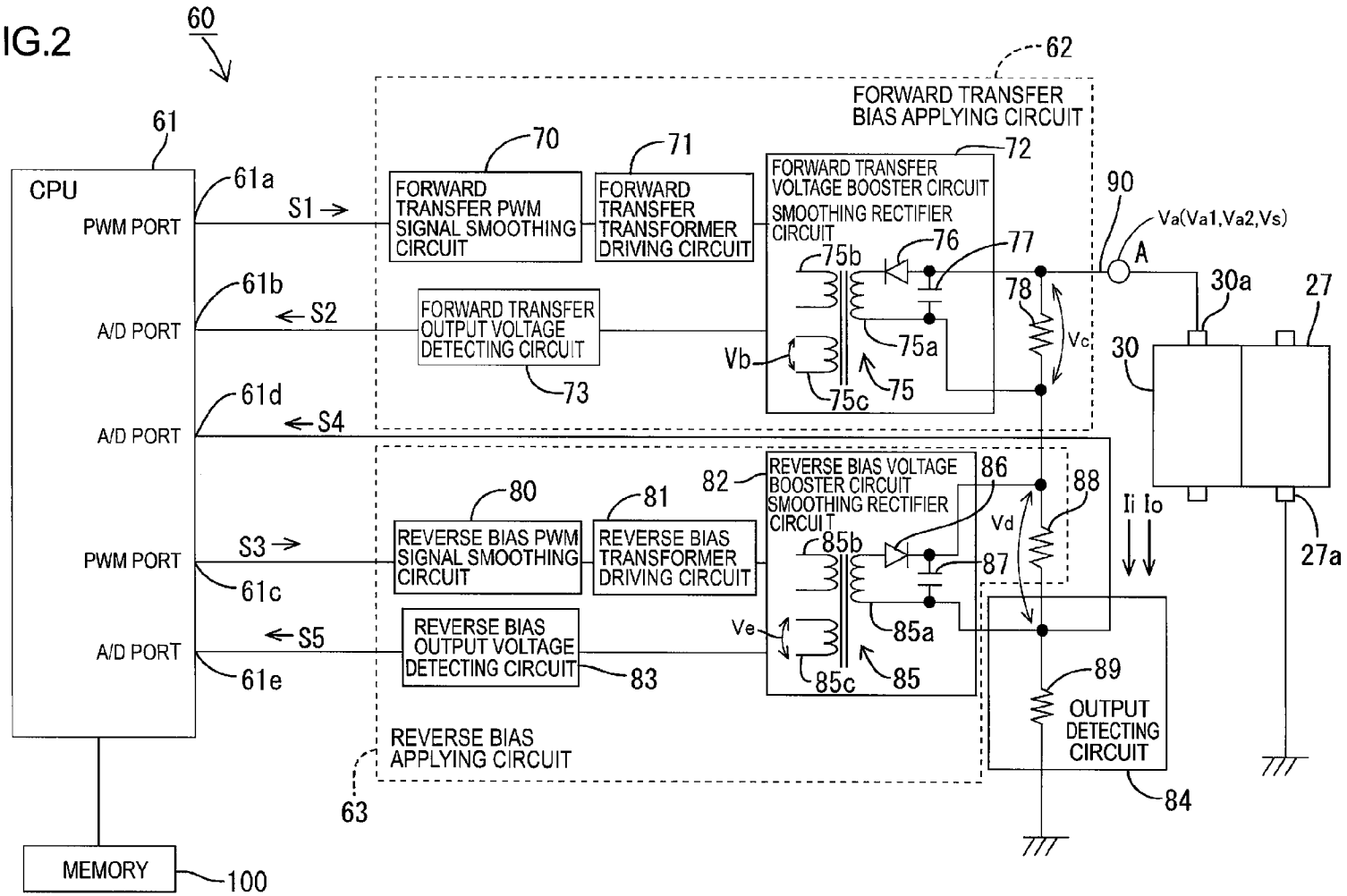
FIG. 2 is a block diagram of a main configuration of a bias applying circuit.

As shown in FIG. 2, the roller shaft 30*a* of the transfer roller 30 is connected to a bias applying circuit 60. The bias applying circuit 60 is mounted on a substrate 52. Furthermore, at a time of transfer operation for transferring the toner image carried on the photosensitive drum 27 to the sheet 3 at the above-described transfer position, a forward transfer bias voltage Va1 (a forward bias voltage) of, for example, −8 kV is applied from the bias applying circuit 60 to the roller shaft 30*a* of the transfer roller 30.

Furthermore, in this illustrative aspect, removal process for removing residual toner is performed as follows. A reverse bias voltage Va2 (a reverse bias voltage) of, for example, 600 V is applied from the bias applying circuit 60 to the transfer roller 30 before and after the image forming operation, in the interval of the transfer operation to the sheets 3 at the time of the image transfer operation, and the like. The reverse bias voltage Va2 has an opposite polarity to that of the forward transfer bias voltage Va1. By this reverse bias voltage Va2, the toner attached to the transfer roller 30 is electrically released onto the photosensitive drum 27. The released toner is, together with the residual toner remaining on the surface of the photosensitive drum 27, thus collected by the developing roller 31.

(c) Fixing Unit

As shown in FIG. 1, the fixing unit 18 is disposed behind, and downstream of, the process cartridge 17. The fixing unit 18 includes a heat roller 41 and a pressure roller 42 for pressing the heat roller 41. In the fixing unit 18, as the sheet 3 passes between the heat roller 41 and the pressure roller 42, the toner carried on the sheet 3 is fused on the sheet 3. Thereafter, the sheet 3 is sent to a sheet exit roller 45 and exits onto a sheet exit tray 46.

2. Bias Applying Circuit

FIG. 2 is a block diagram of a main configuration of the bias applying circuit 60, which applies the bias voltage to the transfer roller 30. As described above, at the time of the forward transfer operation, the bias applying circuit 60 applies the forward transfer bias voltage Va1 to the transfer roller 30. On the other hand, at the time of the removal process for removing the residual toner, the bias applying circuit 60 applies the reverse bias voltage Va2 to the transfer roller 30. Note that, also at a time of toner transfer (specifically, toner-image transfer) which will be described below, the bias applying circuit 60 applies the reverse bias voltage Vs to the transfer roller 30.

The bias applying circuit 60 includes a CPU 61, a forward transfer bias applying circuit 62, and a reverse bias applying circuit 63. The CPU 61 is an illustration of a control circuit, a decision circuit, a setting circuit, and a determination circuit. The forward transfer bias applying circuit 62 (an illustration of a forward bias applying circuit) generates the forward transfer bias voltage Va1. The reverse bias applying circuit 63 (an illustration of a reverse bias applying circuit) generates the reverse bias voltage (Va2 and Vs). Note that the forward bias applying circuit 62 and the reverse bias applying circuit 63 are connected to a connecting line 90 in series in that order. The connecting line 90 is connected to the roller shaft 30*a* of the transfer roller 30.

Furthermore, the bias applying circuit 60 includes an output detecting circuit 84 (one example of a detecting circuit) The output detecting circuit 84 outputs a detection signal S4 in accordance with a value of the current flowing through the connecting line 90. Note that the bias applying circuit 60 further has a circuit for applying other bias voltages such as a charging bias voltage, the illustration of which is omitted. In addition, the bias applying circuit 60 and the CPU 61 is disposed on the substrate 52, which is shown in FIG. 1.

The CPU 61 performs PWM (Pulse Width Modulation) control to execute constant current control of the forward transfer bias applying circuit 62. The CPU 61 also performs PWM control to execute constant voltage control of the reverse bias applying circuit 63. Furthermore, a memory 100 is connected to the CPU 61. Programs for controlling the bias applying circuit 60, a transfer object current value Io, and the like are stored in the memory 100.

(a) Forward Transfer Bias Applying Circuit

The forward transfer bias applying circuit 62 is a self-oscillating high-voltage (negative voltage) generation circuit. The forward transfer bias applying circuit 62 includes a forward transfer PWM signal smoothing circuit 70, a forward transfer transformer driving circuit 71, a forward-transfer-voltage step-up transformer and smoothing rectifier circuit 72, and a forward transfer output voltage detecting circuit 73.

The forward transfer PWM signal smoothing circuit 70 receives a PWM signal S1 from a PWM port 61*a* of the CPU 61, smoothes the PWM signal S1, and sends the smoothed PWM signal S1 to the forward transfer transformer driving circuit 71. Based on the smoothed PWM signal S1, the forward transfer transformer driving circuit 71 supplies self-oscillation current to a primary winding 75*b* of the forward-transfer-voltage step-up transformer and smoothing rectifier circuit 72.

The forward-transfer-voltage step-up transformer and smoothing rectifier circuit 72 includes a transformer 75, a diode 76, a smoothing capacitor 77, and the like. The transformer 75 includes a secondary winding 75*a*, the primary winding 75*b*, and an auxiliary winding 75*c*. An end of the secondary winding 75*a* is connected through the diode 76 to the connecting line 90. On the other hand, the other end of the secondary winding 75*a* has a common connection with the output end of the reverse bias applying circuit 63. In addition, the smoothing capacitor 77 and a resistor 78 are connected in parallel with each other to the secondary winding 75*a*.

With this configuration, the voltage in the primary winding 75*b* is stepped up and rectified in the forward-transfer-voltage step-up transformer and smoothing rectifier circuit 72, and is applied as the forward transfer bias voltage Va1 to the roller shaft 30*a* of the transfer roller 30, which is connected to the output end A of this bias applying circuit 60.

The forward transfer output voltage detecting circuit 73 is connected to the CPU 61 and to the auxiliary winding 75*c* of the transformer 75 of the forward-transfer-voltage step-up transformer and smoothing rectifier circuit 72. During forward transfer operation performed by the forward transfer bias applying circuit 62, the forward transfer output voltage detecting circuit 73 detects an output voltage Vb generated by the auxiliary winding 75*c* and sends a detection signal S2 to an A/D port 61*b* of the CPU 61. Based on the sensor signal S2, the CPU 61 senses a forward transfer output voltage Vc.

(b) Reverse Bias Applying Circuit

Similar to the forward transfer bias applying circuit 62, the reverse bias applying circuit 63 is a self-oscillating high-voltage (positive voltage) generation circuit. The reverse bias applying circuit 63 includes a reverse bias PWM signal smoothing circuit 80, a reverse bias transformer driving circuit 81, a reverse bias voltage step-up transformer and smoothing rectifier circuit 82, and a reverse bias output voltage detecting circuit 83.

The reverse bias PWM signal smoothing circuit 80 receives a PWM signal S3 from a PWM port 61*c* of the CPU 61, smoothes the PWM signal S3, and sends the smoothed PWM signal S3 to the reverse bias transformer driving circuit 81. Based on the smoothed PWM signal S3, the reverse bias transformer driving circuit 81 supplies self-oscillation current to a primary winding 85*b* of the reverse bias voltage step-up transformer and smoothing rectifier circuit 82.

The reverse bias voltage step-up transformer and smoothing rectifier circuit 82 includes a transformer 85, a diode 86, and a smoothing capacitor 87, and the like. The transformer 85 includes a secondary winding 85*a*, the primary winding 85*b*, and an auxiliary winding 85*c*. An end of the secondary winding 85*a* is connected through the diode 86 to the other end of the secondary winding 75*a* of the above-described forward transfer bias applying circuit 62. On the other hand, the other end of the secondary winding 85*a* is grounded through a detection resistor 89 of an output detecting circuit 84. In addition, the smoothing capacitor 87 and a resistor 88 is connected in parallel with each other to the secondary winding 85*a*. Furthermore, the detection resistor 89, which is connected in series to the resistor 88, serves as a current detection resistor; a detection signal S4 in accordance with a value of current flowing through the detection resistor 89 is fed back to an A/D port 61*d* of the CPU 61.

With this configuration, the voltage in the primary winding 85*b* is stepped up and rectified in the reverse bias voltage step-up transformer and smoothing rectifier circuit 82, and is applied to the roller shaft 30*a* of the transfer roller 30 as the reverse bias voltage Va2 for removing residual toner or as the reverse bias voltage Vs for at the time of toner transfer. The roller shaft 30*a* of the transfer roller 30 is connected to the output end A of this bias applying circuit 60.

Furthermore, the reverse bias output voltage detection circuit 83 is connected to the CPU 61 and to the auxiliary winding 85*c* of the transformer 85 of the reverse bias voltage step-up transformer and smoothing rectifier circuit 82. During reverse bias operation performed by the reverse bias applying circuit 63, the reverse bias output voltage detecting circuit 83 detects an output voltage Ve generated by the auxiliary winding 85*c*, and sends a detection signal S5 to an A/D port 61*e* of the CPU 61. Based on the detection signal S5, the CPU 61 detects a reverse bias output voltage Vd.

Thus, at a time of the forward transfer operation, the CPU 61, along with sending the PWM signal S1 to the forward transfer bias applying circuit 62 and thereby driving the forward transfer bias applying circuit 62, executes the constant current control. In the constant current control, based on the detection signal S4 in accordance with the value of the current flowing through the connecting line 90, the CPU 61 properly modulates the duty ratio of the PWM signal S1 so that the value of the current flowing through the connecting line 90 is equal to the transfer object current value Io, and outputs the PWM signal S1 having the modulated duty ratio to the forward transfer PWM signal smoothing circuit 70.

Furthermore, at a time of the reverse bias operation, the CPU 61, along with sending the PWM signal S3 to the reverse bias applying circuit 63 and thereby driving the reverse bias applying circuit 63, executes the constant voltage control. In the constant voltage control, based on the detection signal S4 in accordance with the value of the current flowing through the detection resistor 89, the CPU 61 properly modulates the duty ratio of the PWM signal S3 so that the reverse bias voltage (each of Va2 and Vs) is equal to a predetermined constant voltage value, and outputs the PWM signal S3 having the modulated duty ratio to the reverse bias PWM signal smoothing circuit 80.

Here, both at the time of the forward transfer operation and at the time of the reverse bias operation, the detection signal (voltage signal) S4 from the output detecting circuit 84 is fed back to the CPU 61 through the shared A/D port 61*d*. Since the forward transfer bias voltage Va1 (e.g. −8 kV) applied at the time of the forward transfer operation and the reverse bias voltage Va2 (e.g. 600 V) applied at the time of the reverse bias operation differ in voltage value, the detection resistor 89 produces different detection voltage level ranges, each of which are dedicated to each operation.

3. Control at the Time of Toner Transfer

Figure 3:
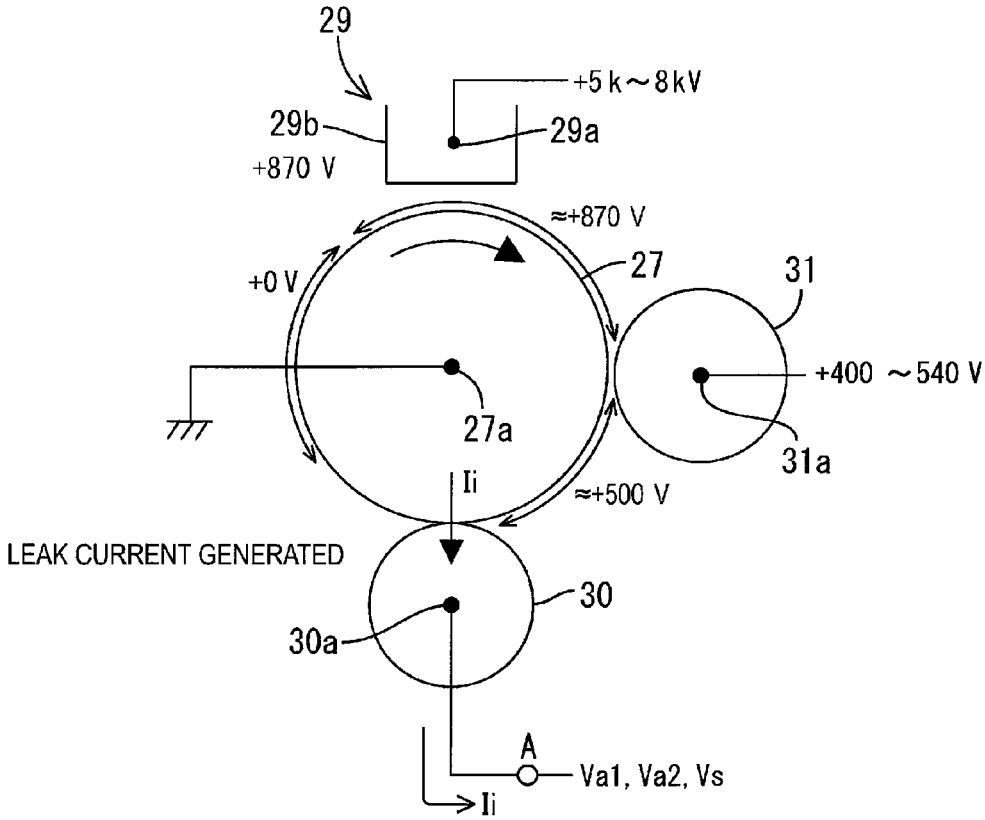
FIG. 3 is a diagram showing inflow (leak) current related to a transfer process of the laser printer.

With the laser printer 1 of this illustrative aspect, in order to transfer the toner image carried on the surface of the photosensitive drum 27 onto the sheet 3, the predetermined forward transfer bias voltage Va1 (e.g. −8 kV) is applied from the forward transfer bias applying circuit 62, as described above. However, the photosensitive drum 27 is charged to about 500 V to 870 V by the scorotron charger 29 and the developing roller 31 at the time of toner transfer. Because of the influence of the potential caused by this charge, so-called leak current (hereinafter referred to as "transfer inflow current") Ii flows into the forward transfer bias applying circuit 62 side, as shown in FIG. 3, through the transfer roller 30 that is in contact with the photosensitive drum 27.

In an event that this transfer inflow current Ii flows through the detection resistor 89 and the detection signal S4 is supplied to the CPU 61, the CPU 61 can determine that the self-oscillating forward transfer bias applying circuit 62 has been already started up, and may be unable to perform the normal start-up control of the forward transfer bias applying circuit 62. Thus, because of this, there is a concern that start-up of the forward transfer bias applying circuit 62 could be disabled. To avoid this concern, described hereinafter are methods of controlling the bias applying circuit 60 in accordance with the present invention to eliminate the influence of the transfer inflow current Ii at the time of toner transfer and thereby to normally start up the forward transfer bias applying circuit 62.

First, a method of controlling the bias applying circuit 60 of the first illustrative aspect will be described with reference to a flowchart of FIG. 4 to control the bias applying circuit 60 and a time chart of FIG. 5. The CPU 61 executes the control shown in this flowchart. The time chart of FIG. 5 shows an illustration of a time course of each signal for applying the reverse bias voltage Vs at the time of toner transfer.

Figure 4:
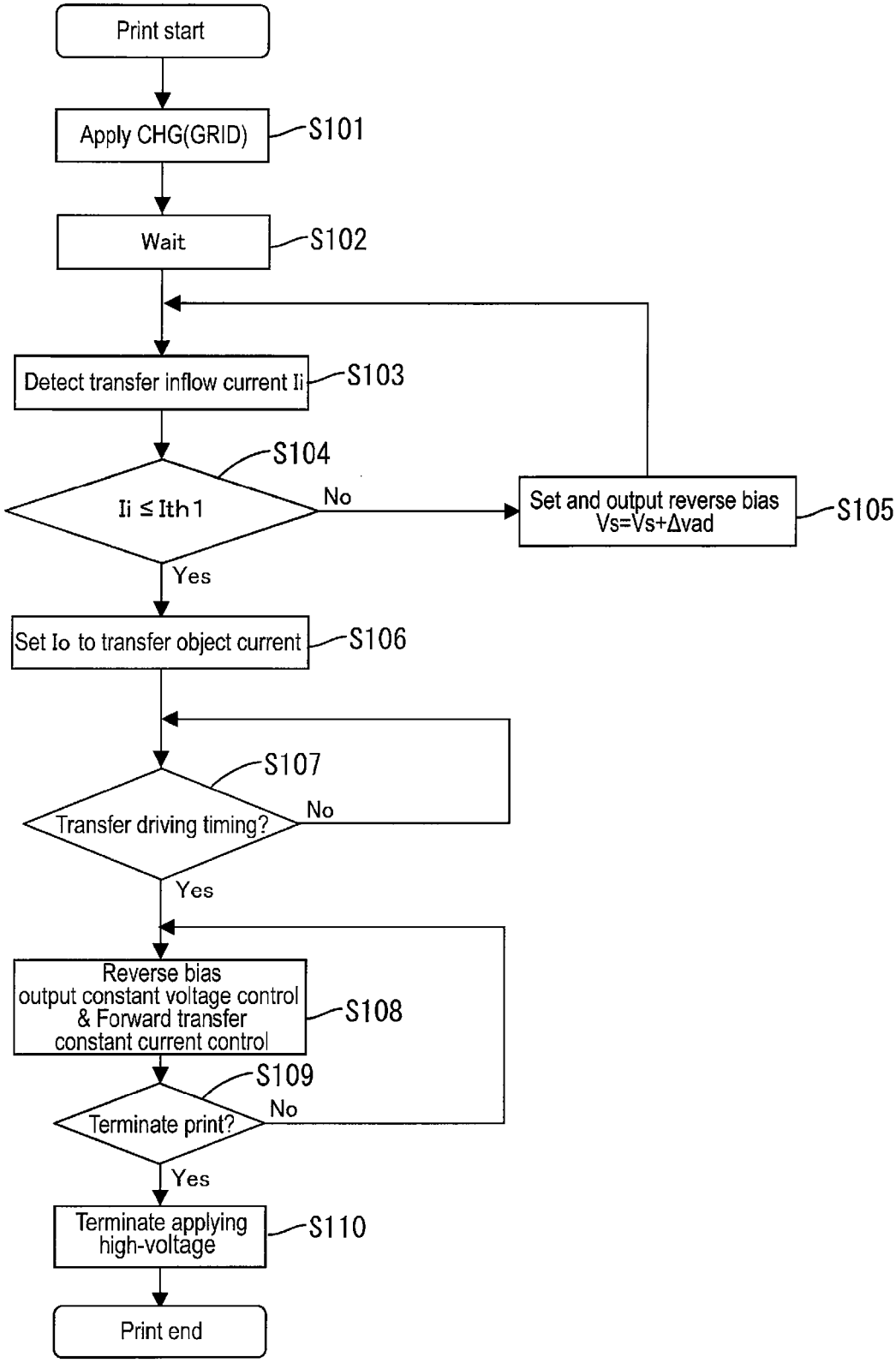
FIG. 4 is a flowchart showing processing contents of a first illustrative aspect in accordance with the present invention.
Figure 5:
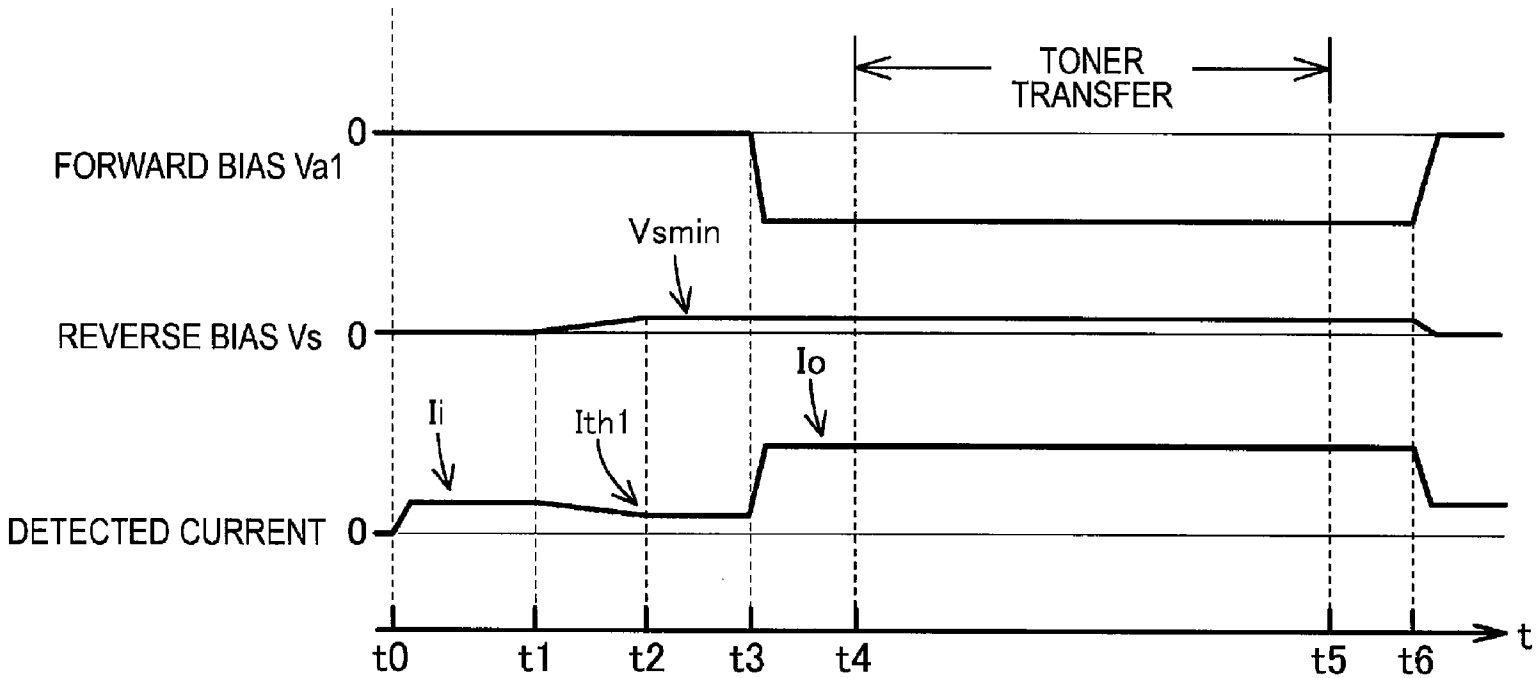
FIG. 5 is a time chart showing an illustration of a time course of each signal for applying a reverse bias voltage Vs of the first illustrative aspect.

When a printing process is started according to a print instruction supplied to the image forming apparatus 1 by the user, the CPU 61 applies the predetermined charging bias voltage (e.g. 5 kV to 8 kV) using the charging bias generation circuit (not illustrated) to the charger 29, and thereby charges the surface of the photosensitive drum 27 (see a time point t0 in FIG. 5) in step S101 in FIG. 4. Next, in step S102, the CPU 61 waits for a predetermined time period. The purpose of waiting for the predetermined time period is to obtain a stabilized state of the transfer inflow current Ii.

Upon a lapse of the predetermined waiting time period, the value of the transfer inflow current Ii is detected using the detection resistor 89 in step S103, and it is determined whether or not the value of the transfer inflow current Ii is equal to or less than a predetermined value Ith1 (corresponding to a "first predetermined value"). Note that this predetermined value Ith1 is found in advance by experiments and the like as a value of the transfer inflow current Ii which does not influence on the start-up operation of the forward transfer bias applying circuit 62.

When it is determined in step S104 that the value of the transfer inflow current Ii is not equal to or less than the predetermined value Ith1, i.e. that the value of the transfer inflow current Ii exceeds the predetermined value Ith1, the process goes to step S105. In the step S105, a predetermined additional voltage amount ΔVad, e.g. 100 V, is added to the reverse bias voltage Vs at that time point and thereby a new value of the reverse bias voltage Vs is set. Note that, in the step S105 in an initial process cycle, the new reverse bias voltage Vs shall be, for example, 100 V, which is simply the additional voltage amount ΔVad.

Then, in order to reduce the transfer inflow current Ii, the new reverse bias voltage Vs is applied using the reverse bias applying circuit 63 to the transfer roller 30. Next, the process returns to the step S103 to detect again the transfer inflow current Ii, and performs the determination of the step 104. This operation is repeated until the transfer inflow current Ii is reduced to a value equal to or less than the predetermined value Ith1 (corresponding to a time point t1 to a time point t2 in FIG. 5).

Then, when it is determined in the step S104 that the value of the transfer inflow current Ii is equal to or less than the predetermined value Ith1 (see a time point t2 in FIG. 5), the process goes to step S106. In the step S106, the predetermined transfer object current value Io is set without change as the transfer object current value, and a value of the reverse bias voltage Vs at that time point is stored in, for example, the memory 100 as the lower limit Vsmin of the reverse bias voltage Vs. Note that the transfer object current value Io should be found in advance by experiments and the like as a value matching, for example, the print circumstances and the like, and be stored in the memory 100.

Next, it is determined in step S107 whether or not that time point is a transfer driving timing. When it is not the transfer driving timing, the determination processing of the step S107 is repeated. On the other hand, when it is the transfer driving timing (corresponding to a time point t3 in FIG. 5), the process goes to step S108. In the step S108, the constant voltage control of the reverse bias applying circuit 63 is performed so that the lower limit Vsmin of the above reverse bias voltage is maintained. Along with this, the constant current control of the forward transfer bias applying circuit 62 is performed so that the forward bias voltage Va1 is applied and thereby the transfer object current Io is obtained.

Note that, when it is determined in the step S104 in the initial process cycle that the value of the transfer inflow current Ii is equal to or less than the predetermined value Ith1, there is no influence of the transfer inflow current Ii on start-up of the forward transfer bias applying circuit 62. Therefore, in this case, the reverse bias voltage Vs is not applied to the transfer roller 30, and the constant voltage control of the reverse bias applying circuit 63 is not performed in the step S108.

Next, it is determined in step S109 whether or not the given printing process is terminated and, when it is not terminated, the process returns to the step S108 to continue the above-described constant voltage control and the constant current control. On the other hand, when it is determined that the printing process is terminated (corresponding to a time point t6 in FIG. 5), the process goes to step S110 to terminate the high-voltage applying process through the bias applying circuit 60. Thus, this printing process is terminated.

Note that, as shown in FIG. 5, the toner transfer process onto the sheet 3 is performed in the time period between the time point t4 and the time point t5 in FIG. 5 during the period of applying the forward bias voltage Va1 and the reverse bias voltage Vs.

<Effects of First Illustrative Aspect>

With the first illustrative aspect, when the detected value of the transfer inflow current Ii exceeds the first predetermined value Ith1 (that is the value whereby the transfer inflow current Ii does not influence on start-up of the forward bias applying circuit 62), the lower limit Vsmin of the reverse bias voltage Vs is found based on the detected value of the transfer inflow current Ii. Then, at least before the forward bias voltage Va1 is applied to the transfer roller 30, the reverse bias voltage of the found lower limit Vsmin is applied to the transfer roller 30 (see the time point t2 in FIG. 5).

Therefore, by applying the reverse bias voltage of the lower limit Vsmin at least before the forward bias voltage Va1 is applied to the transfer roller 30, the influence of the transfer inflow current Ii can be suitably eliminated when transferring the toner image onto the sheet 3. In this case, because the value of the reverse bias voltage Vs can be optimized to a lower voltage, efficient control for stably operating the forward bias applying circuit 62 can be realized.

Furthermore, when the forward bias voltage Va1 is off, and when the detected value of the transfer inflow current Ii exceeds the first predetermined value Ith1, the CPU 61 gradually increases the reverse bias voltage Vs in accordance with the transfer inflow current Ii detected by the output detecting circuit 84, and thereby decreases the transfer inflow current Ii. Then, the CPU 61 determines the value of the reverse bias voltage Vs at the time point where the transfer inflow current Ii becomes equal to or less than the first predetermined value Ith1 as the lower limit Vsmin of the reverse bias voltage Vs. Therefore, a minimum reverse bias voltage Vsmin for stably operating the forward bias applying circuit 62 can be suitably found.

Furthermore, because the reverse bias applying circuit 63, which is provided for generating the reverse bias voltage Va2 for removing residual toner, is used as the means for generating the reverse bias voltage Vs for the time of toner transfer, higher efficiency can be obtained.

<Second Illustrative Aspect>

Next, a second illustrative aspect in accordance with the present invention will be described with reference to a flowchart of FIG. 6 to control the bias applying circuit 60. Note that the processing identical with that of the flowchart of FIG. 4 of the second illustrative aspect will be designated by the identical numerals, while the descriptions will be omitted; and will only describe the differences from those of the first illustrative aspect. Further, the main configuration of the image forming apparatus 1 and the configuration of the bias applying circuit 60 are identical with those of the first illustrative aspect and, therefore, the descriptions will be omitted.

In the second illustrative aspect, when the transfer inflow current Ii is equal to or greater than a predetermined value Ith2 (corresponding to a "second predetermined value"), the transfer process is performed by performing constant current control of the transfer inflow current Ii using the reverse bias applying circuit 63. That is, in the second illustrative aspect, when the transfer inflow current Ii is large to some extent, the transfer inflow current Ii is used as the transfer current, and the transfer current is controlled using the reverse bias applying circuit 63 instead of the forward transfer bias applying circuit 62.

Figure 6:
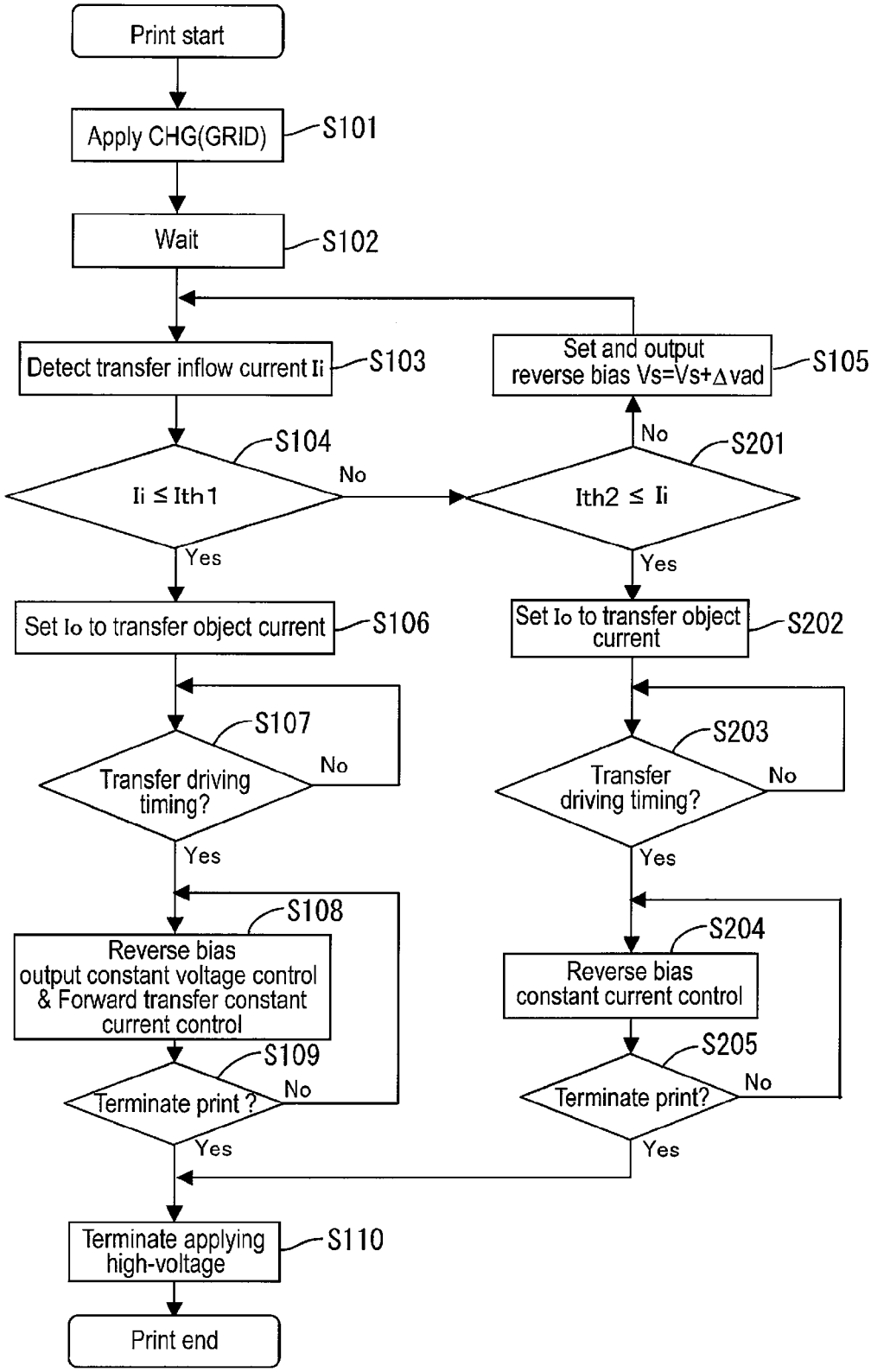
FIG. 6 is a flowchart showing processing contents of a second illustrative aspect in accordance with the present invention.

That is, when it is determined in step S104 in FIG. 6 that the value of the transfer inflow current Ii is neither equal to or less than the predetermined value Ith1, i.e. that the value of the transfer inflow current Ii exceeds the predetermined value Ith1, the process goes to step S201. In the step S201, the CPU 61 determines whether or not the value of the transfer inflow current Ii is equal to or greater than the second predetermined value Ith2, which is greater than the predetermined value Ith1 (e.g. twice as large as the transfer object current Io).

When the value of the transfer inflow current Ii is less than the second predetermined value Ith2 (i.e. when the value of the transfer inflow current Ii is greater than the first predetermined value Ith1 and less than the second predetermined value Ith2), the process goes to step S105. In the step S105, the reverse bias voltage Vs is set and the reverse bias voltage Vs is applied as described above, so that the transfer inflow current Ii is decreased. Next, the processing of the steps S104, S105, and the like are repeated so that, similar to the first illustrative aspect, the lower limit reverse bias voltage Vsmin is found. Then, similar to the first illustrative aspect, the processing of the step S106 and the subsequent steps are performed.

On the other hand, when the value of the transfer inflow current Ii is equal to or greater than the second predetermined value Ith2, the step goes first to step S202. In the step S202, similar to the step S106, the transfer object current is set at the predetermined value Io. Next, in step S203, similar to the step S107, it is determined whether or not that a time point is the transfer driving time. When it is not the transfer driving timing, the determination processing of the step S203 is repeated. On the other hand, when it is the transfer driving timing, the process goes to step S204. In the step S204, the CPU 61 performs the constant current control of the reverse bias applying circuit 63 so that the transfer inflow current Ii is decreased to the transfer object current Io and the transfer object value Io is maintained.

Next, similar to the step S109, it is determined in step S205 whether or not the given printing process is terminated and, when it is not terminated, the process returns to the step S204 to repeat the above processing. On the other hand, when it is determined that the printing process is terminated, the process goes to step S110. In the step S110, the high-voltage applying processing performed using the bias applying circuit 60 is terminated. Thus, the printing process of the second illustrative aspect is terminated.

<Effects of Second Illustrative Aspect>

With the second illustrative aspect, when the transfer inflow current Ii is equal to or more than the second predetermined value Ith2 (which is greater than the first predetermined value Ith1), the transfer inflow current Ii is controlled using the reverse bias applying circuit 63. Therefore, when the transfer inflow current Ii is equal to or greater than the predetermined value Ith2, the constant current control for transferring the toner image can be performed using only the reverse bias applying circuit 63. This serves for reducing power consumption of the transfer system.

<Third Illustrative Aspect>

Figure 7:
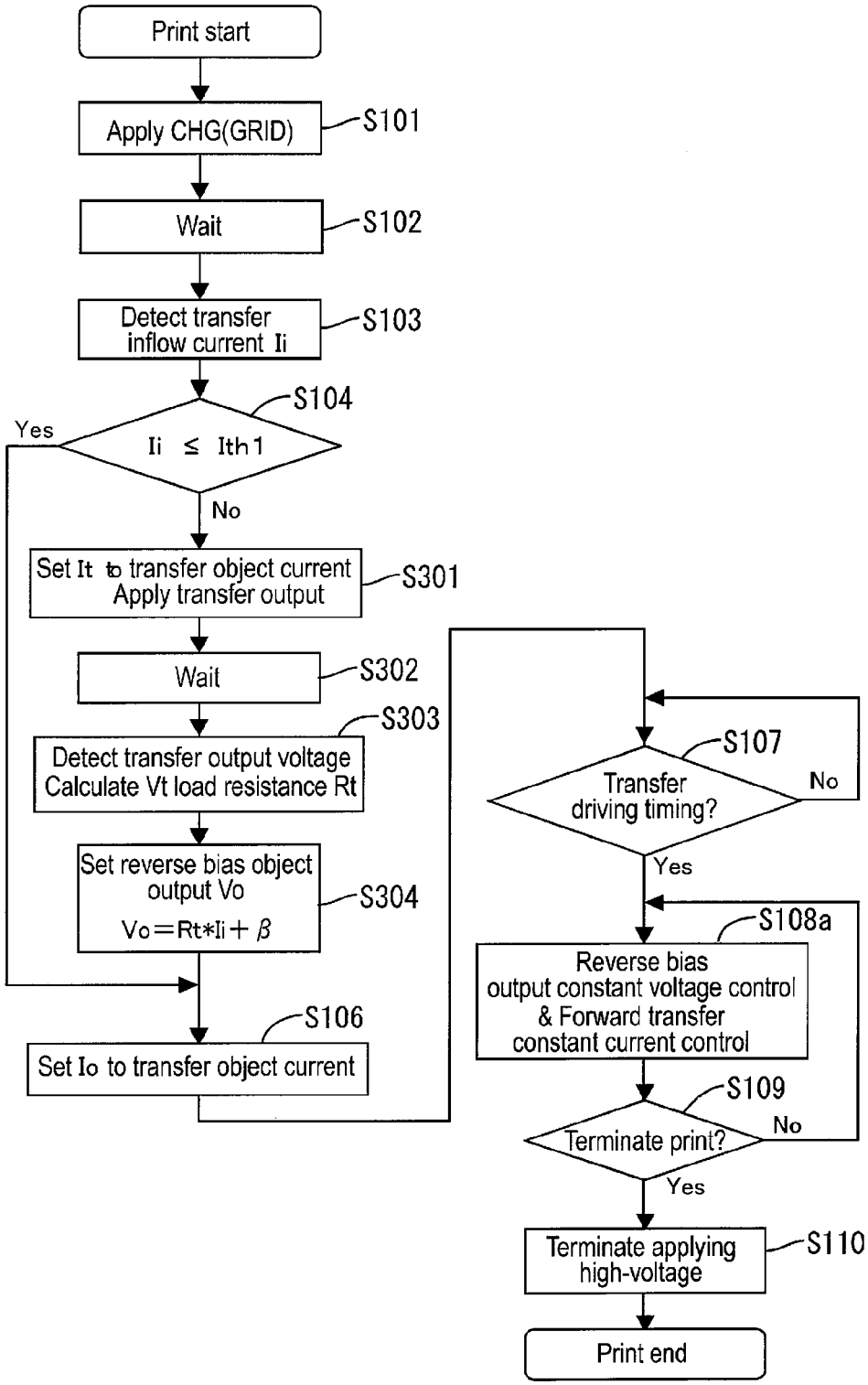
FIG. 7 is a flowchart showing processing contents of a third illustrative aspect in accordance with the present invention.
Figure 8:
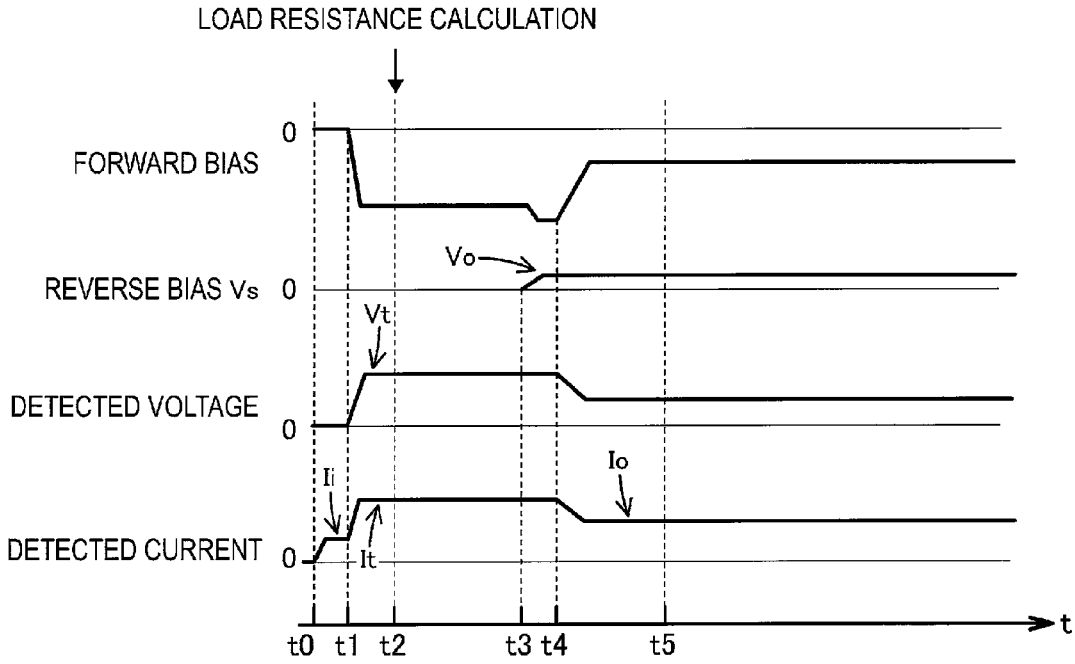
FIG. 8 is a time chart showing an illustration of a time course of each signal for applying the reverse bias voltage Vs of the third illustrative aspect.

Next, a third illustrative aspect in accordance with the present invention will be described with reference to FIGS. 7 and 8. FIG. 7 shows a flowchart to control the bias applying circuit 60. Note that the processing identical with that of the flowchart of FIG. 4 of the second illustrative aspect will be designated by the identical numerals, while the descriptions will be omitted; and only will describe the differences from those of the first illustrative aspect. Furthermore, the main configuration of the image forming apparatus 1 and the configuration of the bias applying circuit 60 are identical with those of the first illustrative aspect and therefore the descriptions will be omitted. Similar to FIG. 5, a time chart of FIG. 8 shows a time course of each signal for applying the reverse bias voltage Vs at the time of toner transfer.

In the third illustrative aspect, the CPU 61 calculates a load resistance Rt to the forward transfer bias applying circuit 62. The load resistance Rt is configured by the photosensitive drum 27 and the transfer roller 30. Based on the calculated load resistance Rt and the transfer inflow current Ii, an electric potential of the transfer roller 30 when the transfer inflow current Ii is flowing thereinto is estimated. Then, a value that exceeds the estimated electric potential of the transfer roller 30 by a predetermined additional voltage β is found as the lower limit Vsmin of the reverse bias voltage. In this illustrative aspect, the lower limit Vsmin of the reverse bias voltage is set as a reverse bias object output Vo and, at the time of toner transfer, the reverse bias object output Vo is applied to the transfer roller 30 before the forward bias voltage Va1 is applied.

Specifically, the CPU 61, similar to the first illustrative aspect, determines in step S104 in FIG. 7 whether or not the value of the transfer inflow current Ii is equal to or less than the predetermined value Ith1. Then, when it is determined that the value of the transfer inflow current Ii exceeds the predetermined value Ith1, the process first goes to step S301. In the step S301, a value of the transfer object current It to be supplied for calculating the load resistance Rt is set as a value obtained by adding a predetermined additional current value α to the detected transfer inflow current Ii. Then, constant current control of the forward transfer bias applying circuit 62 is performed so that the transfer object current It is obtained (see a time point t1 of FIG. 8).

Note here that the additional current value α is a predetermined current value to be added to a detected value of the transfer inflow current Ii so that start-up of the forward transfer bias applying circuit 62 is suitably performed. The additional current value α is found in advance by experiments and the like. For example, the additional current value α is set at 2 μA.

Next, the CPU 61 waits for a predetermined time period in step S302 until the constant current control is stabilized. Then, in step S303, based on the detection signal S2 of the forward transfer output voltage detection circuit 73 of the forward transfer bias applying circuit 62, detects a forward transfer output voltage Vt. Then, the load resistance Rt is calculated from this forward transfer output voltage Vt (Vc) and the transfer object current It (see the time point t2 in FIG. 8).

Note that the load resistance Rt is calculated using formula 1 as follows (see FIG. 2).

$$Vt=It*(Rt+R88+R89) \quad \text{(Formula 1)}$$

Next, in step S304, using the load resistance Rt calculated using the formula 1, the transfer inflow current Ii detected in the step S104, and the predetermined additional voltage β, and using formula 2 as follows, the reverse bias object output Vo is calculated and is set.

$$Vo=Rt*Ii+\beta \quad \text{(Formula 2)}$$

Here, the terms "Rt*Ii" is estimated to be the electric potential, which is supplied by the transfer inflow current Ii, of the transfer roller 30. Therefore, in order to reliably control the transfer inflow current Ii, the reverse bias object output Vo is set as a value obtained by adding the additional voltage β to the estimated electric potential. Therefore, start-up of the forward transfer bias applying circuit 62 at the time of toner transfer is suitably performed without being influenced by the transfer inflow current Ii.

Next, in steps S106 and S107, the processing similar to the first illustrative aspect is performed. Then, in step S108*a*, the reverse bias object output Vo is started being applied (see the time point t3 in FIG. 8), and constant voltage control of the reverse bias applying circuit 63 is performed so that the reverse bias object output Vo is maintained. Furthermore, the setting of the forward transfer bias applying circuit 62 is changed (see a time point t4 in FIG. 8) so that the transfer object current Io at the time of toner transfer is obtained. Thereafter, the constant current control of the forward transfer bias applying circuit 62 is performed so that the transfer object current Io is maintained. Note that, in the third illustrative aspect, the toner transfer process is started from the time point t5 in FIG. 8.

Next, similar to the first illustrative aspect, the processing of the steps S109 and S110 is performed. Thus, the printing process of the third illustrative aspect is terminated.

Note that, when it is determined in the step S104 that the value of the transfer inflow current Ii is equal to or less than the predetermined value Ith1, the process jumps to the processing of the step S106 and the subsequent steps. Furthermore, because there is no influence of the transfer inflow current Ii on start-up of the forward transfer bias applying circuit 62 in this case, it is unnecessary to apply the reverse bias voltage Vs to the transfer roller 30. Therefore, the constant voltage control of the reverse bias applying circuit 63 is not performed in the step S108*a*.

<Effects of Third Illustrative Aspect>

With the third illustrative aspect, in order to determine the reverse bias object output Vo as the lower limit of the reverse bias voltage Vs, the load resistance Rt (which is configured by the photosensitive drum 27 and the transfer roller 30), to the forward transfer bias applying circuit 62 is calculated. Then, based on the load resistance Rt and the transfer inflow current Ii, the electric potential of the transfer roller 30 at the time when the transfer inflow current Ii is flowing thereinto is estimated. Then, the value that exceeds the estimated electric potential of the transfer roller 30 by the additional voltage β is set as the reverse bias object output Vo. That is, because the reverse bias object output Vo is calculated based on the detected value detected in a single detecting operation, the lower limit of the reverse bias voltage can be promptly found.

<Fourth Illustrative Aspect>

Next, a fourth illustrative aspect in accordance with the present invention will be described with reference to FIG. 9, which shows a flowchart to control the bias applying circuit 60. Note that the processing identical with that of the flowchart of FIG. 4 of the first illustrative aspect will be designated by the identical numerals, while the descriptions will be omitted; and will only describe the differences from those of the first illustrative aspect. Furthermore, the main configuration of the image forming apparatus 1 and the configuration of the bias applying circuit 60 are identical with those of the first illustrative aspect, and therefore the descriptions will be omitted.

The fourth illustrative aspect differs from any one of the above illustrative aspects 1 through 3 in that the reverse bias voltage Vs is not applied to the transfer roller 30 at the time of start-up of the forward transfer bias applying circuit 62. That is, in the fourth illustrative aspect, in order to perform toner transfer, the forward transfer bias applying circuit 62 is suitably started up without using the reverse bias voltage Vs and without being influenced by the transfer inflow current Ii.

Figure 9:
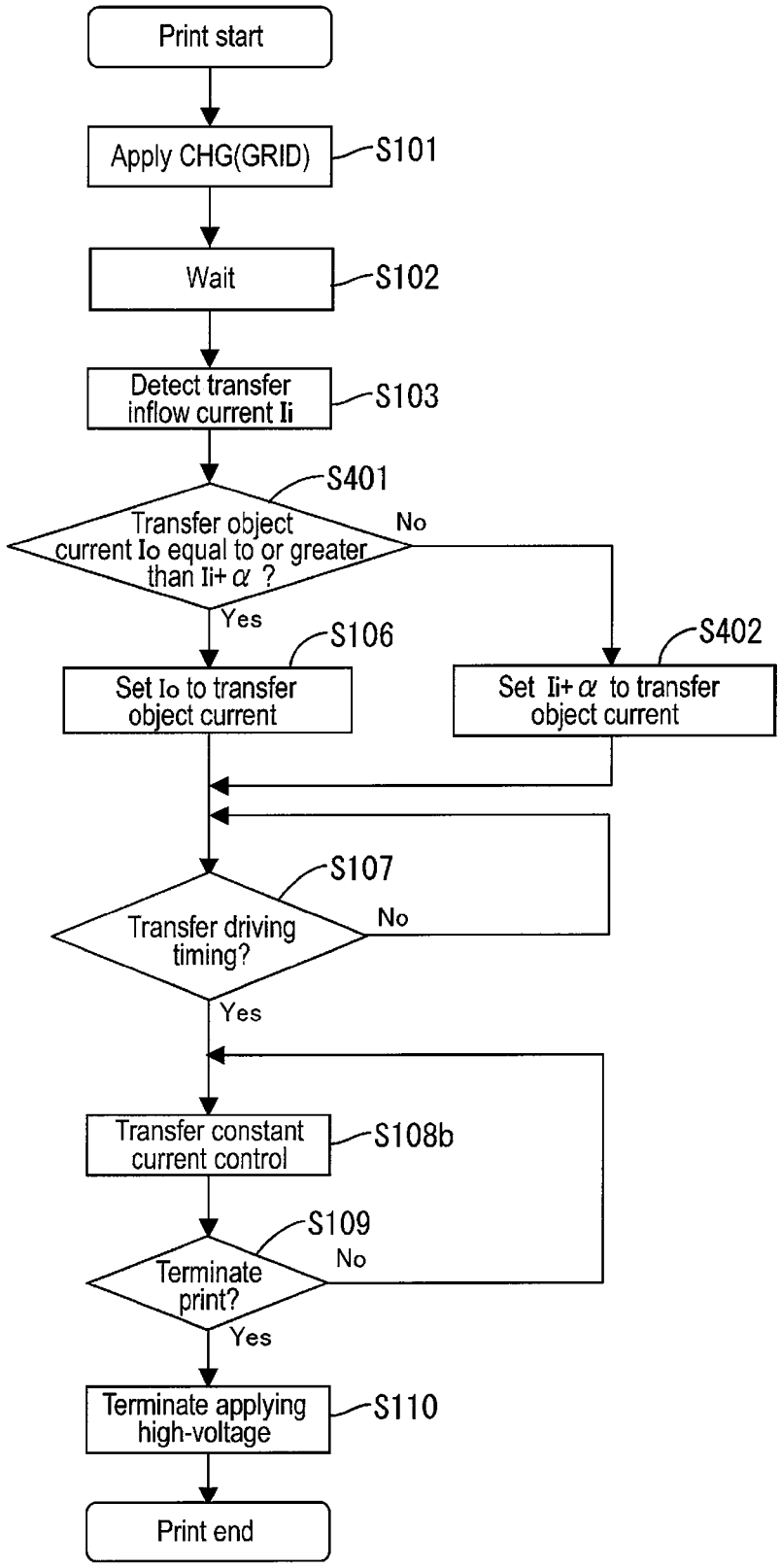
FIG. 9 is a flowchart showing processing contents of a fourth illustrative aspect in accordance with the present invention.

Specifically, the CPU 61 determines in step S401 in FIG. 9 whether or not the preset transfer object current value Io is equal to or greater than a value obtained by adding the predetermined additional current value α to the detected transfer inflow current Ii (Ii+α). When the predetermined transfer object current value Io is neither equal to nor greater than the value obtained by adding the predetermined additional current value α to the transfer inflow current Ii (Ii+α) (i.e. when the transfer object current value Io is less than "Ii+α"), the process goes to step S402. In the step S402, the setting of the transfer object current value is changed to "Ii+α". Then, subsequently, similar to the first illustrative aspect, the processing of steps S107 through S110 is performed. Thus, the printing process of the fourth illustrative aspect is terminated.

On the other hand, when the preset transfer object current value Io is equal to or greater than "Ii+α" in the determination processing of the step S401, the process goes to the step S106. In the step S106, the preset transfer object current Io is set without change as the transfer object current value. Then, subsequently, the processing of the steps of S107 through S110 is performed similar to the first illustrative aspect. Thus, the printing process of the fourth illustrative aspect is terminated.

Note that the additional current value α is a predetermined current value that is added to the detected transfer inflow current Ii so that start-up of the forward transfer bias applying circuit 62 is suitably performed without being influenced by the transfer inflow current Ii, as described in the step S301 of the third illustrative aspect. The value is found in advance by experiments and the like. For example, the additional current value α is 2 μA in this fourth illustrative aspect.

Furthermore, in the fourth illustrative aspect, because it is unnecessary to apply the reverse bias voltage Vs to the transfer roller 30, constant voltage control of the reverse bias applying circuit 63 is not performed. Therefore, performed in step S108*b* is only constant current control using the forward transfer bias applying circuit 62 for maintaining the transfer object current.

<Effects of Fourth Illustrative Aspect>

With the fourth illustrative aspect, by properly selecting the predetermined additional current value α to be added to the detected transfer inflow current value Ii, the forward transfer bias applying circuit 62 can be suitably started up simply based on the detected transfer inflow current value Ii and, furthermore, a smaller transfer object current in a normal transfer-operation range can be set. That is, where there is the predetermined difference between the preset transfer object current value Io and the detected transfer inflow current value Ii, the CPU 61 can distinguish between the transfer object current value Io and the transfer inflow current Ii by the difference there between. Therefore, the CPU 61 can normally perform the start-up control of the forward transfer bias applying circuit 62.

<Other Illustrative Aspects>

The present invention is not limited to the illustrative aspects described above with reference to the drawings. For example, the following illustrative aspects are also included within the scope of the present invention.

(1) In the first illustrative aspect, it is illustratively shown that the operation of applying the forward bias voltage Va1 and the operation of applying the reverse bias voltage Vs is simultaneously terminated at the time point t6 in FIG. 5. The present invention is not limited to this. For example, the reverse bias voltage Vs may be terminated earlier than the termination of the forward bias voltage Va1 in the time period between the time point t5 and the time point t6 in FIG. 5, or the reverse bias voltage Vs may be terminated later than the termination of the forward bias voltage Va1 after the time point t6 in FIG. 5.

The relationship between the applying times of the forward bias voltage Va1 and the reverse bias voltage Vs should only be such that, essentially, at the time of toner transfer, the reverse bias voltage of the lower limit value Vsmin (or Vo) is applied to the transfer roller 30 at least before the forward bias voltage Va1 is applied to the transfer roller 30. This can also be applied in any one of the other illustrative aspects.

(2) The predetermined additional voltage amount ΔVad in the step S105 in either of the first and second illustrative aspects is not limited to a fixed value. For example, the value may be varied depending on the number of the determination processing cycles of the step S104 or the difference between the transfer inflow current value Ii and the first predetermined value Ith1. The reverse bias voltage Vs should be gradually increased in accordance with the detected transfer inflow current value Ii with the control configuration of the step S105.

(3) The configuration of the steps S201 through S205 of the second illustrative aspect (i.e. the configuration to control the transfer inflow current value Ii using the reverse bias applying circuit 63 when the transfer inflow current value Ii greater than the second predetermined value Ith2, which is greater than the first predetermined value Ith1), may be included in the configuration to control the bias applying circuit 60 of the third illustrative aspect.

(4) In the step S104 in either of the second and third illustrative aspects, the predetermined value Ith1 may be the additional inflow current value (Ii+α) shown in the fourth illustrative aspect.

What is claimed is:

1. An image forming apparatus comprising:

an image carrier configured to carry a developer image developed with developer;

a transfer device configured to transfer the developer image to a recording media;

a forward bias applying circuit configured to apply a forward bias voltage to the transfer device, the forward bias voltage having a polarity opposite to the developer;

a reverse bias applying circuit configured to apply a reverse bias voltage to the transfer device, the reverse bias voltage having a polarity opposite to the forward bias voltage;

a detecting circuit configured to detect inflow current flowing from the image carrier through the transfer device into the forward bias applying circuit;

a decision circuit configured to determine whether a detected value of the inflow current exceeds a first predetermined value; and a controller configured to, when the forward bias voltage is off and the decision circuit determines that the detected value of the inflow current exceeds the first predetermined value, gradually increase the reverse bias voltage until the detected value of the inflow current is reduced to a value equal to or less than the first predetermined value, wherein the decision circuit is further configured to determine a value of the reverse bias voltage as a lower limit of the reverse bias voltage when the detected value of the inflow current becomes equal to or less than the first predetermined value as a result of the gradual increase in the reverse bias voltage by the controller, and wherein the reverse bias applying circuit is configured to apply the reverse bias voltage of the determined lower limit to the transfer device at least before the forward bias voltage is applied to the transfer device.

2. The image forming apparatus according to claim 1, wherein the forward bias applying circuit includes a self-oscillating circuit.

* * * * *